US009718601B2

(12) United States Patent
Stahlecker et al.

(10) Patent No.: US 9,718,601 B2
(45) Date of Patent: Aug. 1, 2017

(54) DOUBLE-WALLED CUP

(75) Inventors: Werner Stahlecker, Goeppingen (DE); Uwe Messerschmid, Albershausen (DE); Holger Aubele, Boehmenkirch (DE)

(73) Assignee: PTM PACKAGING TOOLS MACHINERY PTE. LTD., Singapore (SG)

( * ) Notice: Subject to any disclaimer, the term of this patent is extended or adjusted under 35 U.S.C. 154(b) by 1150 days.

(21) Appl. No.: 12/380,423

(22) Filed: Feb. 27, 2009

(65) Prior Publication Data

US 2009/0230178 A1 Sep. 17, 2009

(30) Foreign Application Priority Data

Mar. 12, 2008 (DE) ..... 10 2008 014 878

(51) Int. Cl.
*B31C 11/04* (2006.01)
*B65D 81/38* (2006.01)

(52) U.S. Cl.
CPC .... *B65D 81/3869* (2013.01); *B31B 2217/003* (2013.01); *B31B 2217/062* (2013.01); *B31B 2217/082* (2013.01)

(58) Field of Classification Search
CPC ..... B31B 2217/003; B31B 2217/062; B31B 2217/082; B65D 81/3869
USPC ..... 493/276, 99, 100, 152, 153, 379
See application file for complete search history.

(56) References Cited

U.S. PATENT DOCUMENTS 4,007,670 A 2/1977 Albano et al.
5,145,107 A * 9/1992 Silver et al. ..... 229/403
5,460,323 A * 10/1995 Titus ..... 229/403
5,524,817 A * 6/1996 Meier et al. ..... 229/403
5,660,326 A * 8/1997 Varano et al. ..... 229/403
5,685,480 A * 11/1997 Choi ..... 229/403
5,752,653 A * 5/1998 Razzaghi ..... 229/403
5,775,577 A 7/1998 Titus
5,887,743 A * 3/1999 Stahlecker et al. ..... 220/270
(Continued)

FOREIGN PATENT DOCUMENTS

CN 1232769 A 10/1999
CN 1495100 A 5/2004
(Continued)

OTHER PUBLICATIONS

Chinese Patent Office Second Office Action issued in Patent Application No. 200910128610.9 dated Apr. 26, 2012 (7 pages).
(Continued)

*Primary Examiner* — Sameh Tawfik
(74) *Attorney, Agent, or Firm* — Flynn, Thiel, Boutell & Tanis, P.C.

(57) ABSTRACT

A double-walled cup and a process for production of the cup are described. The cup includes an inner cup and a tube-shaped outer sleeve, which is formed from a blank of paper material joined at its ends. The tube-shaped outer sleeve is slid axially onto a prefabricated inner sleeve and secured. The tube-shaped outer sleeve is formed from a flat blank by joining the ends of the blank before being slid on, whereby the ends of the blank are joined by an adhesive applied to a limited area of the outer sleeve. The ends of the blank are joined by a thermoplastic material in the form of an adhesive, which for example can be a hot-melt adhesive or a sealing varnish.

4 Claims, 2 Drawing Sheets

(56) References Cited

U.S. PATENT DOCUMENTS

| | | | | |
|---|---|---|---|---|
| 6,109,518 | A | 8/2000 | Mueller et al. | |
| 6,341,474 | B1 | 1/2002 | Focke et al. | |
| 7,451,910 | B2 | 11/2008 | Frost et al. | |
| 2002/0111260 | A1 | 8/2002 | Sand | |
| 2006/0237465 | A1 | 10/2006 | D'Amato | |
| 2008/0023537 | A1 | 1/2008 | Frost et al. | |
| 2008/0280743 | A1 | 11/2008 | Stahlecker et al. | |
| 2009/0020597 | A1 | 1/2009 | D'Amato | |
| 2009/0166402 | A1 | 7/2009 | D'amato | |
| 2009/0170680 | A1 | 7/2009 | D'amato | |
| 2009/0294456 | A1* | 12/2009 | Messerschmid | 220/660 |
| 2010/0173764 | A1* | 7/2010 | Messerschmid | 493/128 |

FOREIGN PATENT DOCUMENTS

| | | | |
|---|---|---|---|
| DE | 198 40 841 | A1 | 3/2000 |
| DE | 10 2007 024243 | A1 | 1/2008 |
| DE | 10 2007 030864 | B2 | 1/2008 |
| EP | 0695692 | A2 | 2/1996 |
| EP | 1227 043 | A1 | 7/2002 |
| EP | 1 785 370 | A1 | 5/2007 |
| EP | 1 990 184 | A1 | 11/2008 |
| GB | 457 684 | | 12/1936 |
| GB | 2435255 | A | 8/2007 |
| JP | 2001 192015 | A | 7/2001 |

OTHER PUBLICATIONS

European Patent Office Search Report dated Jul. 28, 2011 (7 pages) with English translation of categories of cited documents.

* cited by examiner

DOUBLE-WALLED CUP

FIELD OF INVENTION

The present invention relates to a process for the manufacture of a double-walled cup in which a tube-shaped outer sleeve made of paper material is axially slid onto a prefabricated inner cup and attached thereto, whereby, before being slid onto the inner cup, the tube-shaped outer sleeve is formed from a flat blank by means of joining the ends of the blank, and whereby the ends of the blank are joined together by means of applying an adhesive to a limited area of the outer sleeve. The present invention further relates to a cup manufactured according to this process.

BACKGROUND OF THE INVENTION

A process of this type is prior art in German published patent application DE 198 40 841 A1. A cold glue is applied as an adhesive to a limited area on the flat blank. The ends of the blank are glued together so that a tube is formed. This tube is slid in the form of an outer sleeve onto a prefabricated inner cup. Due to the stability of the tube-shaped prefabricated outer sleeve, an essentially ring-shaped air space can be formed between the outer sleeve and the inner sleeve of the cup, whereby the outer sleeve and the inner sleeve do not come into contact along the air space. The thickness of the essentially ring-shaped air space can be increased due to a discontinuous widening in the upper area of the inner sleeve, so that the insulation effect of the cup is improved.

By using cold glue as an adhesive for joining the ends of the blank of the outer sleeve, the outer sleeve can be made from a very cost-effective paper material. The blanks for the outer sleeve can consist of a single-layered paper material without additional plastic coating. In contrast to the inner cup, whose paper material comprises a plastic coating on the side forming the inner space, the outer sleeve does not come into contact with the liquid poured into the cup. A non-coated paper material is therefore sufficient for achieving the isolation effect of the double-walled cup.

The gluing of the ends of the blanks with cold glue limits the working speed of the manufacturing apparatus, as cold glue requires a relatively long time before it sets. As a result, the ends of the blank must remain pressed together for a relatively long time, in order to prevent the adhesive attachment from dissolving. In addition, the processing of cold glue is complex, as cold glue often exhibits fluctuations in viscosity, which prevents an exact dosage of the amount of glue applied. Excessive glue application results in contamination of the production machine, so that the machine often has to be stopped for cleaning.

SUMMARY OF THE INVENTION

It is an object of the present invention to create an improved process for the production of double-walled cups.

This object has been achieved in accordance with the present invention in that a thermoplastic material is used as an adhesive for joining the ends of the blank to form a tube-shaped outer sleeve.

A thermoplastic material, for example a hot-melt adhesive, can be applied to limited areas of the outer sleeve with a defined viscosity and joins the ends very quickly when pressed together. The speed of the production of the double-walled cup is greatly increased as a result. In addition, the machine is not contaminated by inexact dosages of adhesive, so that frequent cleaning procedures are omitted. The hot-melt adhesive is applied in liquid form to defined areas of the blank before the ends of the blank are joined to form a tube-shaped outer sleeve. The ends of the blank need only be pressed together for a short time in order to form a secure and stable bond.

In an embodiment, a thermoplastic material in the form of sealing varnish can also be used. The sealing varnish can be applied to the flat blank in a procedural step prior to the actual production process of the double-walled cup or at least prior to the forming of the outer sleeve. The sealing varnish can for example be applied in the form of a stripe on one end of the blank, before the blank is fed to the production machine for the double-walled cup. The application of the sealing varnish can take place for example in a printing machine. The sealing varnish is thus already solidified on the flat blank and does not disturb the feeding of the blank to the cup production machine. When the ends of the blank are joined together to form the outer sleeve, the sealing varnish is re-heated, so that the ends are glued together after being briefly pressed together. The application of sealing varnish before the blank for the outer sleeve is fed to the cup production machine has the advantage that no application or dosing devices for adhesives need be present in the cup production machine. Any contamination by adhesives can be effectively prevented. The sealing varnish can be applied very sparingly in defined areas of the outer sleeve where it is required for bonding. In addition to the ends of the blank, the joining of the tube-shaped outer sleeve to the inner sleeve can also be effected by a thermoplastic material in the form of an adhesive. For this purpose, a stripe of sealing varnish can be applied along a curved edge of the blank.

A further advantage of the use of sealing varnish as a thermoplastic material for joining the outer sleeve is that in the cup-producing machine, devices for joining the ends of the blank can be used similarly to the way they are applied for joining the inner sleeve in the production of the inner cup. The blanks for the outer sleeve with the sealing varnish printed onto defined areas can be processed in principle identically to the blanks for the inner cup coated with polyethylene foil. Sealing devices of this type are known so that a detailed description can be omitted at this point.

The design of the inner cup is optional. It can for example consist of a paper material. The inner cup can also be a plastic cup. The design of the outer sleeve can also take many forms. The outer sleeve can for example be made from a smooth paper material or from a fluted paper material.

The use of a thermoplastic material as an adhesive for the tube-shaped outer sleeve is particularly advantageous when the inner cup displays a discontinuous widening in diameter in the form of a shoulder in the upper area of the inner sleeve. The jump in diameter is located close below a lip of the inner cup so that a narrow area for attaching the outer sleeve remains between the widening and the lip. This area for attaching the outer sleeve normally lies above the level of hot liquid with which the cup is filled. Below the discontinuous widening in diameter, an essentially ring-shaped air space is located between the outer sleeve and the inner sleeve, along which air space the outer sleeve and the inner sleeve do not come into contact. The joining point of the ends of the blank of the tube-shaped outer sleeve extending along the longitudinal axis of the cup is also separated by means of this air space from the inner sleeve in contact with the hot liquid. There is therefore no risk that the joining points on the outer sleeve adhered by means of the thermoplastic material will solubilize when hot liquid is poured into the double-walled cup. In the non-generic European published patent application EP 1 785 370 A1, the application of a hot-melt adhesive for temporarily joining an outer sleeve to an inner sleeve is described. The outer sleeve is not adhered in the form of a tube, but rather wound directly around the sleeve of the inner cup and adhered there. A cold glue is applied in addition to the hot-melt adhesive for permanent adherence. The disadvantages of the application of cold glue have been described above. The cold glue is necessary in the embodiment of the European published patent application EP 1 785 370 A1, as the joining between the inner sleeve and the outer sleeve, created by the hot-melt adhesive, may solubilize again when hot liquid is poured into the cup, and there is a risk that the outer sleeve may tear open, as a result of the internal stress of the paper material, and fall from the inner cup.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION

Figure 1:
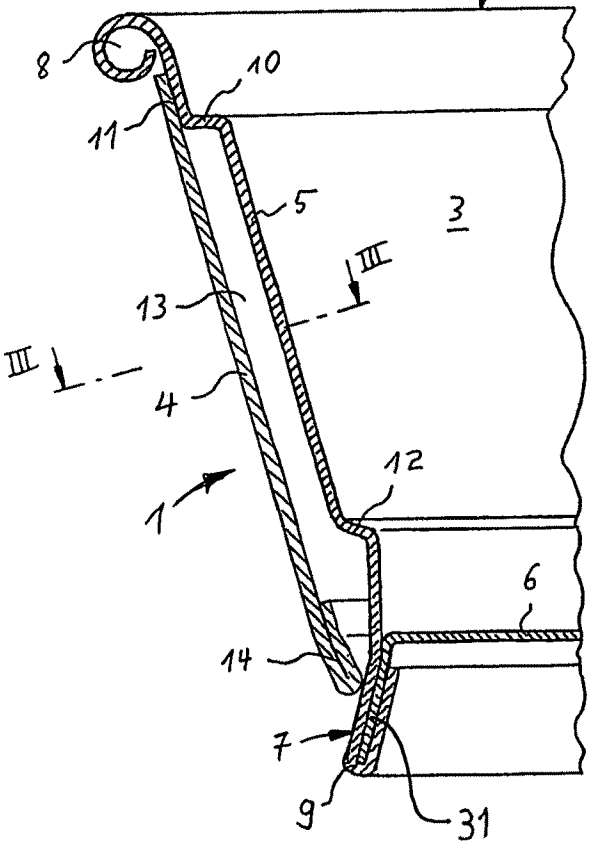
FIG. 1 is a partly shown double-walled cup in longitudinal section.

The double-walled cup 1 shown in FIG. 1 comprises essentially an inner cup 2 having an interior space 3 which can be filled and also an outer sleeve 4. The fillable interior space 3 of the inner cup 2 is formed by a conical inner sleeve 5 and a pot-shaped bottom 6. The open side of the pot-shaped bottom 6 is arranged in such a way that it is facing away from the filling opening of the cup 1. The bottom 6 with its wall 31 is joined liquid-tight to the sleeve 2 in the area of its smallest diameter by means of the formation of a bottom skirt 7. In the area of the bottom skirt 7, the material of the inner sleeve 5 is placed around the wall 31 of the bottom 6 and folded inwards. The inner sleeve 5 comprises at its top rim, that is, in the area of its largest circumference, an outwardly rolled lip 8, which surrounds the filling opening.

The conical feature of the inner sleeve 5 is hereby understood in that the inner sleeve 5 tapers in longitudinal section as shown in FIG. 1 from the lip 8 to the bottom 6 at least in certain areas. The form of the inner sleeve 5 in cross section is hereby irrelevant. The inner sleeve 5 is advantageously circular in cross section, but can alternatively be oval for example, or rectangular with rounded corners. The inner cup has a truncated cone shape in the case of a round cross section of the conical inner sleeve 5, while in the case of a rectangular cross section of the cup, it is more likely to be a truncated pyramid shape.

The bottom skirt 7 comprises at least in one area along its periphery an outwardly projecting widening 9. The widening 9 can alternatively extend only over a lower portion of the bottom skirt 7. A lower edge of the widening 9 on the bottom skirt 7 forms the standing surface for the cup 1. The cup 1 stands, when in use, on its standing surface, which is enlarged by the widening 9. This makes it difficult for the cup 1 to tip over. The widening 9 is advantageously designed continuously around the circumference of the bottom skirt 7.

In the case of cups 1 made of paper material, the bottom skirt 7 is a very important element of the cup 1. The bottom skirt 7 is vital for the joining between the inner sleeve 5 and the bottom 6. The material of the bottom 6 is adhered or sealed to the material of the inner sleeve 5 in the area of the bottom skirt 7 in order to be liquid-tight for at least a certain amount of time. The term "paper material" can involve various materials having at least one layer of paper, paperboard or cardboard, out of which the bottom and the inner sleeve 5 are made. In addition, the material can comprise one or several layers of plastic and/or aluminum. Advantageously the paper material is coated on the side bordering the inner space 3 with a thin plastic layer, advantageously of polyethylene. In contrast to pure plastic material, the shaping and in particular the stretching properties of such paper materials are limited. In the case of too much shaping, the paper material itself or also the provided coating can tear, so that the liquid tightness is impaired. In the case of cups 1 from paper material, the bottom skirt is therefore 7 a significant design feature which cannot be omitted.

In the area below the lip 8, the inner sleeve 5 can advantageously comprise a discontinuous widening in diameter in the form of a shoulder 10, which can be seen as a jump in cross section from the bottom 6 to the lip 8. Between the lip 8 and the shoulder 10, a supporting surface 11 for the outer sleeve 4 is located on the outer surface of the inner sleeve 5.

In order that a number of double-walled cups 1 can be well stacked and easily de-stacked again, a bead 12 can be formed into the inner sleeve 5 as a means for stacking, on which bead 12 the widening 9 of the bottom skirt 7 of a similar cup to be inserted into the inner space is stacked. The stacked cups 1 are thus prevented from being wedged together.

Figure 3A:
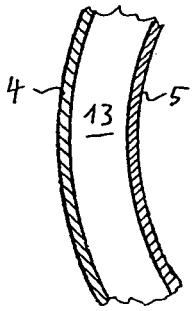
Figure 3B:
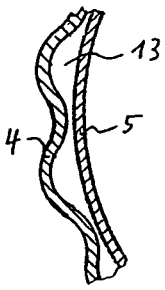

The outer sleeve 4 can be designed in a variety of ways. Two possible designs of the outer sleeve 4 are shown in FIGS. 3A and 3B. A smooth outer sleeve 4 can be seen in FIG. 3A, which outer sleeve 4 surrounds the inner sleeve 5 at a constant distance. A fluted outer sleeve 4 is shown in FIG. 3B. The essentially ring-shaped air space 13 has as a result a varying width. Depending on what is required, it can be provided that the areas of the outer sleeve 4 located nearest to the inner sleeve 5 have an even shorter distance to the inner sleeve 5 or alternatively touch the inner sleeve 5, so that the outer sleeve is supported on the inner sleeve 2, resulting in an improved stability of the double-walled cup 1.

For the manufacture of a double-walled cup 1 a prefabricated inner cup 2 is used in the known way. This prefabricated inner cup 2 is joined to a tube-shaped outer sleeve 4, so that between the outer sleeve 4 and the inner sleeve 5 of the cup 1, an essentially ring-shaped air space 13 is formed, along which the outer sleeve 4 and the inner sleeve 5 do not come into contact. The widening 9 can hereby be formed before or after the outer sleeve 4 has been slid into place. The air space 13 has good insulation properties, so that the double-walled cup 1 can be easily held in the hand when the inner space 3 is filled with very hot liquid. An inwardly curled-in part 14 is provided at the bottom end of the outer sleeve 4, with which the outer sleeve 4 is supported on the inner sleeve 2.

Figure 2:
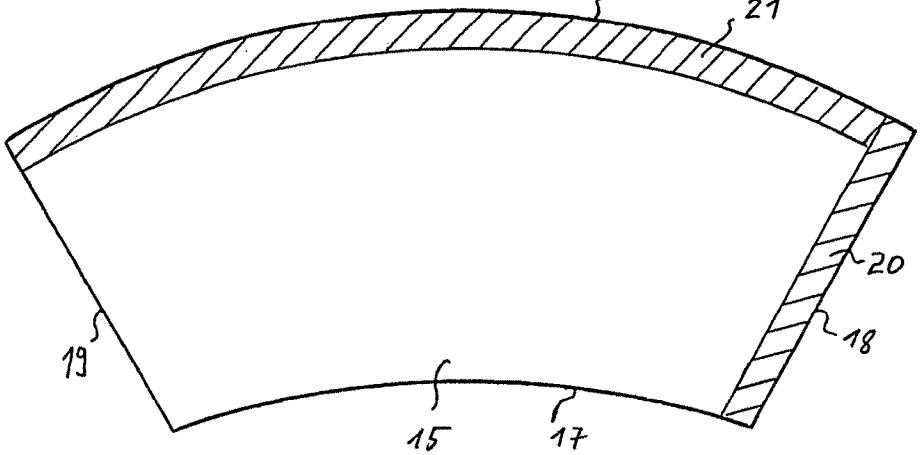
FIG. 2 shows a scaled down flat-lying blank for a tube-shaped outer sleeve of the double-walled cup of FIG. 1, FIGS. 3A and 3B each show an intersectional view along the cutting surface Ill-Ill of FIG. 1, FIGS. 4 to 7 each show views similar to FIG. 1 of various forms of the double-walled cup.

A flat blank 15 shown in FIG. 2 is used for making the outer sleeve 4. The flat blank 15 has approximately the shape of a segment out of a circular ring having two curved edges 16 and 17 and two straight ends 18 and 19. In contrast to the bottom 6 and the inner sleeve 5, the blank 15 for the outer sleeve 4 consists of a non-coated paper material, as the outer sleeve 4 does not come into contact with the poured-in liquid when the cup 1 is in use. For environmental reasons it is advantageous to minimize the amount of plastic-coated paper material in the double-walled cup 1. The double-walled cup 1 is usually used as a non-reusable cup for hot beverages and subsequently disposed of after one use. The less plastic the cup 1 contains, the more paper material can be recycled.

The blank 15 is wound around a conical mandrel and the end 18 is joined to the end 19 in an overlapping way. For the purposes of joining the two ends 18 and 19, an adhesive in the form of a thermoplastic material is applied to a limited area on the end 18. The defined area on the end 18 of the blank 15, to which the thermoplastic material is applied, is denoted in FIG. 2 by hatching having the reference number 20.

Adhesives in the form of two different thermoplastic materials are particularly well suited for joining the ends 18 and 19 of the blank 15 to form the tube-shaped outer sleeve 4. A hot-melt adhesive can be used as a thermoplastic material. The hot-melt adhesive is applied in liquid form to the defined area 20 of the blank 15 before the ends 18 and 19 are joined. A dosing device can be provided for this purpose, which applies the hot-melt adhesive at a defined temperature through a nozzle onto the blank 15. Subsequently, the end 19 is laid over the area 20 on the end 18 and pressed together. The hot-melt adhesive then cools down and the ends 18 and 19 are joined together within a very short time.

A particularly advantageous alternative thermoplastic material can be a sealing varnish. The sealing varnish is printed onto the flat blank 15 in the area 20 by means of a printing machine and becomes hard. Prefabricated blanks 15 comprising the applied sealing varnish in the area 20 can be processed in the cup-producing machine in the manufacture of the double-walled cup 1, without the necessity for a further application of adhesive in the cup-producing machine. The blank 15 with the previously applied sealing varnish in the area 20 is wound around a mandrel, whereby the end 19 is laid over an area 20 on the end 18. By means of a short heating effect, the ends 18 and 19 are pressed together so that the sealing varnish is re-heated, thus adhering the ends 18 and 19 to each other.

Subsequent to the joining of the ends 18 and 19 of the blank 15 to form the tube-shaped outer sleeve 4 with the thermoplastic material acting as an adhesive, the inwardly curled-in part 14 is formed at the curve-shaped edge 17, and the tube-shaped outer sleeve 4 is removed from the mandrel. The tube-shaped outer sleeve 4 is then slid in the axial direction onto the prefabricated inner cup 2 from below and attached to the inner cup 2. Attaching the outer sleeve 4 to the inner cup 2 takes place in that an area on the upper edge 16 of the outer sleeve 4 is place on the supporting surface 11 of the inner sleeve 5. Depending on the type of thermoplastic material applied as an adhesive, the attachment of the tube-shaped outer sleeve 4 to the inner cup 2 can also be carried out in different ways. In the case of an application of hot-melt adhesive, the hot-melt adhesive is applied in liquid form either on the outer sleeve 4 in the area of the upper edge 16 or onto the supporting surface 11 of the inner cup, before the outer sleeve 4 is slid onto the inner cup 2 from below. After sliding the outer sleeve 4 onto the inner sleeve 2, the outer sleeve 4 can be pressed with the inner sleeve 5 in the area between the shoulder 10 and the lip 8.

In the case of an application of sealing varnish as a thermoplastic material, a defined area 21 is provided on the blank 15 along the curve-shaped edge 16 analogous to the area 20 on the end 18, to which defined area 21 sealing varnish is applied. The area 21, is located after the joining of the ends 18 and 19 of the blank, on the inner side of the tube-shaped outer sleeve 4 and comes into contact with the contact surface 11 of the inner cup 2 after the outer sleeve 4 is slid on. To join the outer sleeve 4 with the inner cup 2, the outer sleeve 4 and the inner sleeve 5 are pressed in the area 11 and sealed by heating the sealing varnish which is applied between the inner sleeve 5 and outer sleeve 4.

Pressing the outer sleeve 4 and the inner sleeve 5 in the area 11 with the adhesive in the form of an intermediary thermoplastic material can take place in various ways depending on requirements. A continuous pressing over the entire circumference of the cup 1 can be advantageous, so that a stable attachment between the outer sleeve 4 and the inner cup 2 is formed. It can also be sufficient, however, to press the outer sleeve 4 and the inner sleeve 5 together only at locally defined areas within the area 11, so that the outer sleeve 4 is not attached along the entire circumference of the cup 1 with the inner sleeve 2. For a variation of this type it can be advantageous to apply the thermoplastic material only in those areas which are then subsequently pressed. In the case of a hot-melt adhesive it can for example be sufficient to apply said hot-melt adhesive only in a series of defined points, before the outer sleeve 4 is slid from below onto the inner sleeve 2. In the case of an application of sealing varnish, it can be provided that sealing varnish is applied only in parts of the area 21 along the curve-shaped edge 16 of the blank 15. The amount of thermoplastic material required for the manufacture of the double-walled cup 1 can be hereby minimized.

To illustrate the present invention, various embodiments of double-walled cups 1 are shown in FIGS. 4 to 7. Identical references denote identical parts as in FIGS. 1 and 2. The explanations in reference to the FIGS. 1 and 2 are also identical so that a repeat description is not necessary. In particular, the outer sleeve 4 can take either a smooth or a fluted form in the shown variations in FIGS. 3A and 3B.

Figure 4:
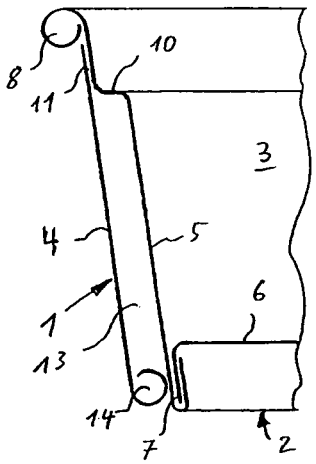

In FIG. 4 a double-walled cup 1 is shown, which differs from the cup in FIG. 1 in that the skirt 7 continues the conical inner sleeve 5 without a widening. The curled-in part 14 of the outer sleeve 4 is not pressed flat and is also supported on the outer circumference of the inner sleeve 5.

Figure 5:
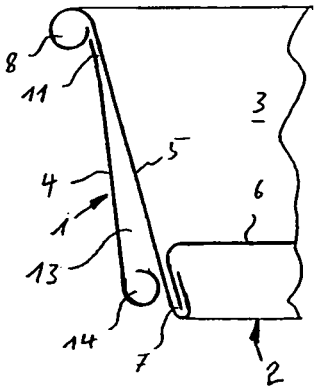

In the case of the double-walled cup 1 of FIG. 5 and in contrast to the cup 1 in FIG. 4, the shoulder 10 below the lip 8 is omitted. The inner sleeve 5 of the inner cup 2 extends at a continuous and constant angle of inclination from the bottom 6 to the lip 8. As the contact surface 11 of the tube-shaped outer sleeve 4 is located in the case of the cup in FIG. 5 above the liquid level in the inner space 3 of the hot liquid to be filled in, there is no risk that the thermoplastic adhesive on the outer sleeve 4 becomes soft again due to the heat of the liquid.

Figure 6:
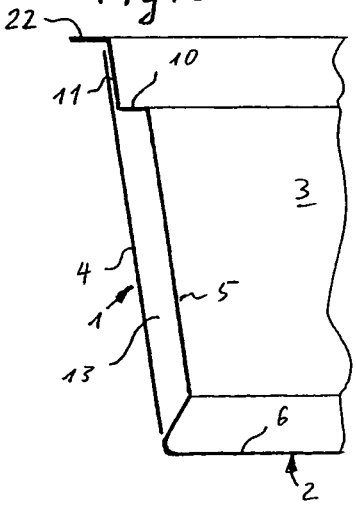

FIGS. 6 shows a double-walled cup 1 which comprises an inner cup 2 made of a synthetic material. In the case of the synthetic inner cup 2, the inner sleeve 5 and the bottom 6 are one-piece parts. A bottom skirt 7, as in the case of the paper material inner cups 2, is not necessary. Instead of a lip 8, the inner cup 2 in FIG. 6 comprises a flange 22, which is formed on the inner sleeve 5 on the upper rim. A shoulder is arranged below the flange 22. The contact surface 11 for the outer sleeve 4 is located between the flange 22 and the shoulder 10.

Figure 7:
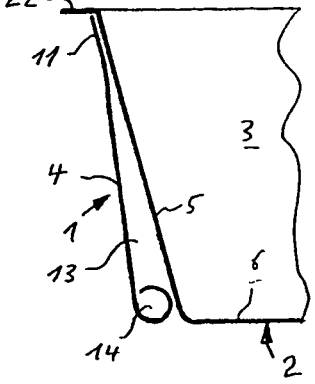

A variation of a double-walled cup 1 is shown in FIG. 7, in which the inner cup 2 is made of a synthetic material as the inner cup 2 of FIG. 6. The inner sleeve 5 according to FIG. 7 extends between the bottom 6 and flange 22 at a constant angle of inclination, which is not interrupted by shoulders or beads. The outer sleeve 4 lies below the flange 22 in the area of a contact surface 11 and has a curled-in part 14 at the lower end of the outer sleeve 4 supported on the inner sleeve 5 of the inner cup 2.

The invention claimed is:

1. A process for manufacturing a double-walled cup, said process comprising the steps of:

providing a prefabricated inner cup having a substantially centrally-located longitudinal axis;

providing a flat blank made of paper and having spaced-apart ends;

applying a thermoplastic adhesive to a limited area of the blank;

joining the ends of the blank to one another via the thermoplastic adhesive to form a tube-shaped outer sleeve;

after said step of joining, sliding the outer sleeve onto the inner cup in a direction substantially parallel with the axis; and attaching the outer sleeve to the inner cup so that the outer sleeve rests on the inner cup only at upper and lower rim areas of the outer sleeve and so that an air gap is formed between the outer sleeve and the inner cup, with the lower rim area of the outer sleeve not being connected to the inner cup, but abutting and loosely resting on the inner cup;

wherein said step of applying includes utilizing a sealing varnish as the thermoplastic adhesive, and applying the sealing varnish to the limited area of the blank before said step of joining and allowing the sealing varnish to harden on the blank, said process further including re-heating the sealing varnish during said step of joining to adhere the ends of the blank to one another.

2. A process for manufacturing a double-walled cup, said process comprising the steps of:

providing a prefabricated inner cup having a substantially centrally-located longitudinal axis;

providing a flat blank made of paper and having spaced-apart ends;

applying a thermoplastic adhesive to a limited area of the blank;

joining the ends of the blank to one another via the thermoplastic adhesive to form a tube-shaped outer sleeve;

after said step of joining, sliding the outer sleeve onto the inner cup in a direction substantially parallel with the axis; and attaching the outer sleeve to the inner cup so that the outer sleeve rests on the inner cup only at upper and lower rim areas of the outer sleeve and so that an air gap is formed between the outer sleeve and the inner cup, with the lower rim area of the outer sleeve not being connected to the inner cup, but abutting and loosely resting on the inner cup;

wherein said step of attaching includes applying the thermoplastic adhesive to only the upper rim area of the outer sleeve and joining the outer sleeve to the inner cup via the thermoplastic adhesive.

3. A process for manufacturing a double-walled cup, said process comprising the steps of:

providing a flat blank made of paper and having spaced-apart terminal end edges;

applying a thermoplastic adhesive to a limited area of the blank adjacent one of the end edges thereof;

joining the end edges of the blank to one another via the thermoplastic adhesive to form a tube-shaped outer sleeve;

providing a prefabricated inner cup having a substantially centrally-located longitudinal axis;

sliding the tube-shaped outer sleeve onto and over the inner cup in a direction substantially parallel with the axis; and attaching the outer sleeve to the inner cup such that a lower edge area of the outer sleeve is not connected to the inner cup, but abuts and loosely rests on the inner cup;

wherein said step of applying includes utilizing a sealing varnish as the thermoplastic adhesive, and applying the sealing varnish to the limited area of the blank before said step of joining and allowing the sealing varnish to harden on the blank, said process further including heating the sealing varnish during said step of joining to adhere the end edges of the blank to one another.

4. A process for manufacturing a double-walled cup, said process comprising the steps of:

providing a flat blank made of paper and having spaced-apart terminal end edges;

applying a thermoplastic adhesive to a limited area of the blank adjacent one of the end edges thereof;

joining the end edges of the blank to one another via the thermoplastic adhesive to form a tube-shaped outer sleeve;

providing a prefabricated inner cup having a substantially centrally-located longitudinal axis;

sliding the tube-shaped outer sleeve onto and over the inner cup in a direction substantially parallel with the axis; and attaching the outer sleeve to the inner cup such that a lower edge area of the outer sleeve is not connected to the inner cup, but abuts and loosely rests on the inner cup;

wherein said step of attaching includes applying the thermoplastic adhesive to only an upper edge area of the outer sleeve and joining the outer sleeve to the inner cup via the thermoplastic adhesive.

* * * * *